United States Patent [19]

Goodell

[11] Patent Number: 4,518,320

[45] Date of Patent: May 21, 1985

[54] VARIABLE DISPLACEMENT PUMP SYSTEM

[75] Inventor: Bradley D. Goodell, Anoka, Minn.

[73] Assignee: Deere & Company, Moline, Ill.

[21] Appl. No.: 576,688

[22] Filed: Feb. 3, 1984

[51] Int. Cl.[3] ..... F04B 49/00

[52] U.S. Cl. ..... 417/217; 60/389; 60/392; 60/443; 60/452; 137/596.13; 417/218; 417/222

[58] Field of Search ..... 60/443, 444, 452, 445, 60/389, 391, 392, 494; 417/217, 218–222; 137/596.13, 596.12; 91/374

[56] References Cited

U.S. PATENT DOCUMENTS

| | | | |
|---|---|---|---|
| 3,164,960 | 1/1965 | Weisenbach et al. . | |
| 3,350,881 | 11/1967 | D'Amato . | |
| 3,416,452 | 12/1968 | Misulis . | |
| 3,439,709 | 4/1969 | Schott et al. | 137/596.13 |
| 3,635,021 | 7/1972 | McMillen et al. . | |
| 3,694,108 | 9/1972 | Pensa . | |
| 3,746,115 | 7/1973 | Bosch | 60/445 X |
| 3,758,235 | 9/1973 | Breeden | 417/222 |
| 3,941,514 | 8/1976 | Louis et al. . | |
| 4,212,164 | 7/1980 | Young | 417/218 |
| 4,275,643 | 6/1981 | Knowles | 137/596.13 |
| 4,349,319 | 9/1982 | Byers et al. | 417/222 |
| 4,456,434 | 6/1984 | El Ibiary | 417/218 |

OTHER PUBLICATIONS

Abex Corp., Hydrostatic Transmission Manual, Chap. 2, "Gold Cup Circuitry", pp. 2.1 and 2.3, Apr. 1980.

U.S. Appln., Ser. No. 576,686, filed Feb. 3, 1984.

*Primary Examiner*—Edward K. Look

[57] ABSTRACT

A variable displacement pump has a swashplate controlled by a pair of pistons. A shuttle valve communicates the highest pressure pump workport to an operator-controlled displacement control valve. A pressure-responsive override valve is connected in series between the displacement control valve and the pistons. When an override pressure is achieved, the override valve blocks communication of the control valve with the pair of pistons and communicates the pump workports directly to the pistons for rapid destroking. A neutral bypass valve is formed out of a sleeve of the displacement control valve to bypass control pressure to sump when the displacement control valve is in neutral. A pressure-reducing valve limits the pressure acting on the stroke control valve to limit response rates and reduce erosion. The override valve includes orifices which, in intermediate positions, provide flow rate control of the fluid flow to the swashplate control pistons.

5 Claims, 1 Drawing Figure

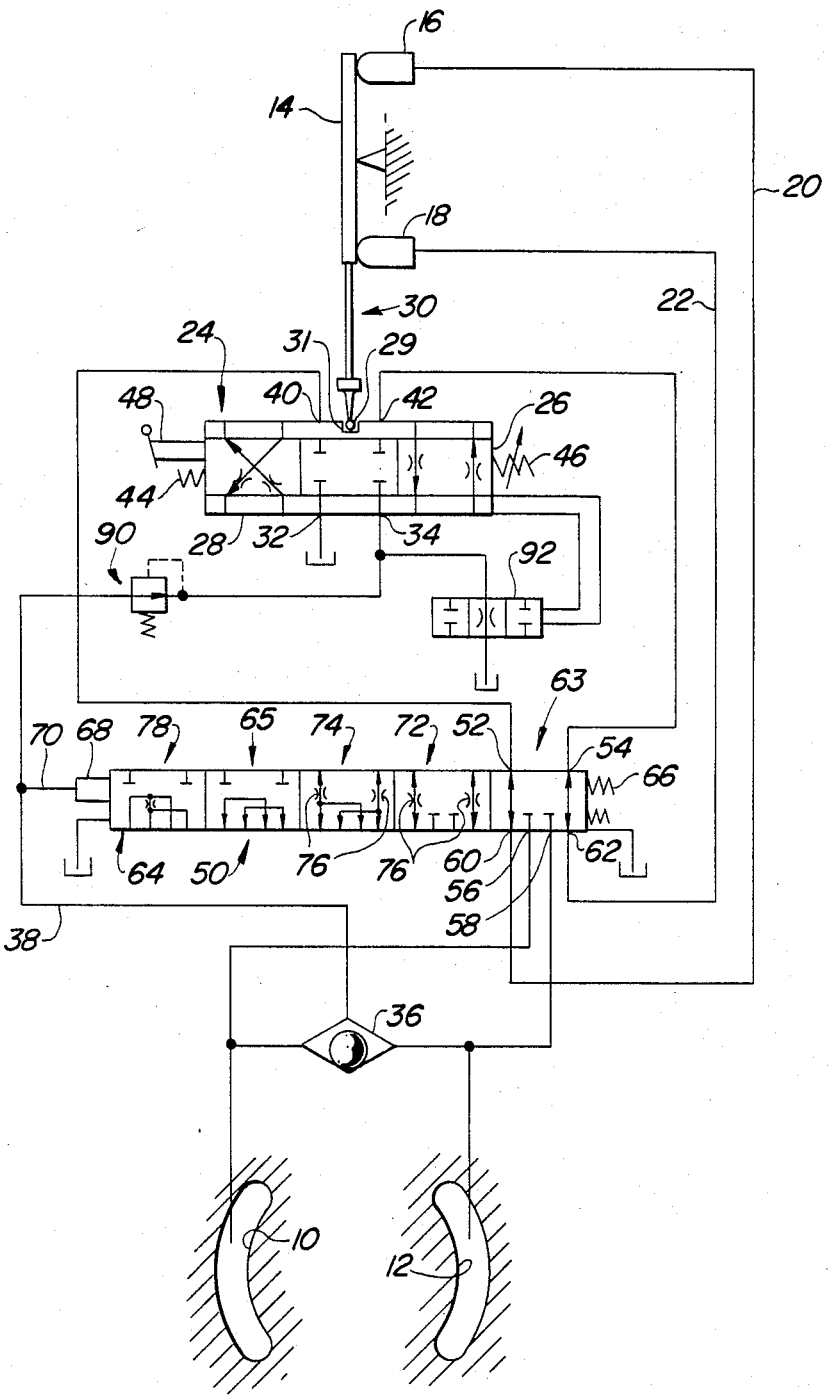
16
14
20
18
22
30
24
31
29
48
40
42
26
46
44
28
32
34
90
92
63
70
68
78
65
74
72
52
54
66
64
50
76
76
60
56
58
62
38
36
10
12

VARIABLE DISPLACEMENT PUMP SYSTEM

BACKGROUND OF THE INVENTION

This invention relates to a variable displacement pump system with an override destroking system.

In conventional axial piston pumps, destroking is achieved by connecting the swashplate or stroke control pistons to sump or drain. With such a destroking system, the time required to fully destroke the pump may be longer than desired. Another axial piston variable displacement pump has a pressure-responsive stroke control device which is exposed to charge fluid pressure for control and which may be exposed to system pressure for override destroking. However, in this system, the override pressure has to work in opposition to the control pressure, resulting in a somewhat inefficient destroking function. One solution to this problem is described in copending U.S. patent application, Ser. No. 576,686, wherein pump workport pressure is used for stroke control and for override destroking. It would be desirable to enhance such a system by providing means for assuring that a vehicle driven by such a system can be positively stopped when the control valve is in neutral. It would further be desirable to add acceleration control capabilities to such a system.

SUMMARY OF THE INVENTION

An object of this invention is to provide a variable displacement pump system with a neutral bypass means which assures that pump flow is neutralized when the pump displacement control valve is in neutral.

Another object of this invention is to provide such a variable displacement pump system with acceleration control capabilities.

These and other objects are achieved by the present invention which includes a variable displacement pump with a swashplate controlled by a pair of pistons. A shuttle valve communicates the highest pressure pump workport to an operator-controlled displacement control valve. A pressure-responsive override valve is connected in series between the displacement control valve and the pistons. When an override pressure is achieved, the override valve blocks communication of the control valve with the pair of pistons and communicates the pump workports directly to the pistons for rapid destroking. A neutral bypass valve is formed out of a portion of a feedback sleeve of the displacement control valve to bypass control pressure to sump when the displacement control valve is in neutral. A pressure reducing valve limits the pressure acting on the stroke control valve to limit response rates and reduce erosion. The override valve includes orifices which, in intermediate positions, provide flow rate control of the fluid flow to the swashplate control pistons.

BRIEF DESCRIPTION OF THE DRAWING

The sole FIGURE is a schematic view of the present invention shown in connection with portions of a conventional variable displacement pump.

DETAILED DESCRIPTION

A variable displacement pump, such as an axial piston pump in a vehicle hydrostatic drive system, has workports 10 and 12 which may be high or low pressure workports, depending upon the position of swashplate 14. The position of swashplate 14 is controlled by pressure-operated displacement control pistons 16 and 18 in response to pressure signals in lines 20 and 22.

An operator-controlled stroke or displacement control valve 24 has a spool 26 slidable within a follower sleeve 28. The follower sleeve senses swashplate position by a follower mechanism or linkage 30. The linkage 30 is preferably a pin with a spherical head 29 or cylindrical head (not shown) received in an aperture 31 in the sleeve 28. The valve 24 has a sump inlet 32 and an inlet 34 which receives fluid pressure from the highest pressure workport via ball-check or shuttle valve 36 and line 38. The valve 24 also has a pair of control pressure outlets 40 and 42. The spool 26 is spring-centered by fixed and variable springs 44 and 46, respectively, and is operator-controlled via pilot 48.

A pressure compensator override valve 50 is connected in series between the stroke control valve 24 and the pistons 16 and 18. Valve 50 has first and second inlets 52 and 54 communicated with stroke control valve outlets 40 and 42, respectively. Valve 50 also has third and fourth inlets 56 and 58, each communicated with one of the pump workports 10 and 12. Valve outlets 60 and 62 are communicated with pistons 16 and 18 via lines 20 and 22. Valve 50 has a spool 64 movable between a first position 63 wherein inlets 56 and 58 are blocked and wherein inlets 52 and 54 are communicated with outlets 60 and 62, respectively, and a second position 65 wherein inlets 52 and 54 are blocked and wherein inlets 56 and 58 are communicated with outlets 62 and 60, respectively. A spring 66 urges the spool 64 towards its first position. A pressure-responsive pilot 68 is communicated with the higher workport pressure from shuttle valve 36 via lines 70 and 38.

The valve 50 also has positions 72 and 74 which are transitional and intermediate between positions 63 and 65. These include orifices 76 for controlling flow rate to the pistons 16 and 18. By having movement of spool 64 change the size of the orifices 76, it is possible to tailor vehicle acceleration and deceleration. The valve 50 also has a position 78 which allows cross-porting of the pump workports 10 and 12 to limit pressure overshoot during power destroking when return oil is directed into the low pressure workport.

A pressure-reducing valve 90 is inserted in line 38 between valve 36 and inlet 34 of stroke control valve 24. This system also includes a neutral bypass valve 92, which is preferably formed by an extension of the sleeve 28.

MODE OF OPERATION

When the operator shifts spool 26 of stroke control valve 24 from the neutral position shown in the FIGURE, the pressure in pistons 16 and 18 becomes unequal and swashplate 14 will pivot, thus producing fluid flow in and out of workports 10 and 12. The pivoting of swashplate 14 causes corresponding shifting of sleeve 28 until the original relationship between sleeve 28 and 26 is reattained, whereupon the pressure in pistons 16 and 18 is equalized and the desired tilt of swashplate 14 is maintained until further spool movement via operator input to pilot 48.

The highest pressure from workports 10 or 12 is communicated to pilot 68 via lines 38 and 70. When this selected pressure reaches a certain pressure, then the spool 64 of override valve 50 will move from the illustrated first position to its second position, wherein the pressure at workports 10 and 12 are communicated to the appropriate pistons 16 and 18 to rapidly destroke the pump by returning the swashplate 14 to its neutral position.

During dynamic braking, (when the pump acts as a motor), the valve 50 forces the pump into stroke. If the pressure continues to increase and the pump reaches full stroke, the cross-port position 78 will limit maximum pressure, allowing significant power absorption by the hydraulic system.

The pressure-reducing valve preferably limits pressure acting on the stroke control valve 24 to a pressure such as 20,000 kPa, thereby limiting the response rates at high pressures for a given size of orifice 76, reducing erosion effects on the stroke control valve 24 and reducing standby power loss to a low value when pump differential pressure is high. The bypass valve 92 shunts remaining pump output to the reservoir through an orifice when the operator moves control valve 24 to neutral to assure that the vehicle stops when on a smooth level surface when the valve 24 is in neutral. Preferably, the bypass valve is completely closed at approximately 10% stroke.

While the invention has been described in conjunction with a specific embodiment, it is to be understood that many alternatives, modifications and variations will be apparent to those skilled in the art in light of the aforegoing description. Accordingly, this invention is intended to embrace all such alternatives, modifications and variations which fall within the spirit and scope of the appended claims.

I claim:

1. A hydraulic system comprising:

a variable displacment pump having high and low pressure workports and pressure-responsive displacement control means for controlling the displacement thereof;

an operator-controlled stroke control valve having a pair of outlets communicated with the displacement control means, a low pressure inlet connected to a reservoir, a high pressure inlet and a valve member movable to control communication between the inlets and outlets, thereby generating fluid pressure stroke control signals at the outlets, the valve member having a neutral position wherein the outlets and inlets are blocked, the stroke control valve comprising a spring-centered, operator-actuatable spool movable within a follower sleeve, the follower sleeve sensing swashplate position via a position feedback linkage, the neutral bypass valve being formed out of an extension of the follower sleeve; and a neutral bypass valve for communicating the high pressure inlet to the reservoir when the valve member of the stroke control valve is in its neutral position.

2. The invention of claim 1, further comprising:

a shuttle valve for communicating the high pressure workport to the high pressure inlet of the stroke control valve; and a pressure-reducing valve coupled between the shuttle valve and the high pressure inlet for limiting the fluid pressure communicated to the high pressure inlet.

3. The invention of claim 1, further comprising:

an override valve connected in series between the stroke control valve outputs and the displacement control means and movable in response to increased pump workport pressure from a normal position wherein stroke control signals from the stroke control valve are communicated to the stroke control means to an override position wherein pump workport pressures are communicated to the displacement control means to reduce pump displacement, the override valve having positions intermediate the normal and override positions wherein the stroke control signals are communicated to the stroke control means via orifices.

4. The invention of claim 3, wherein the override valve has a first intermediate position wherein the stroke control signals are communicated to the stroke control means via an orifice and wherein communication between the pump workports and the stroke control means is blocked, the override valve having a second intermediate position wherein the stroke control signals are communicated to the stroke control means via an orifice and wherein pump workport pressures are communicated to the displacment control means to reduce pump displacement.

5. The invention of claim 4, wherein the override valve further comprises:

a further position wherein the stroke control signals are blocked from communicating with the stroke control means, wherein pump workport pressures are communicated to the displacement control means to reduce pump displacement and wherein pump workports are communicated with each other via an orifice.

* * * * *

UNITED STATES PATENT AND TRADEMARK OFFICE

CERTIFICATE OF CORRECTION

PATENT NO. : 4,518,320

DATED : 21 May 1985

INVENTOR(S) : Bradley Denver Goodell

It is certified that error appears in the above-identified patent and that said Letters Patent is hereby corrected as shown below:

Column 3, line 50, delete ", the".
Column 4, lines 1 and 2, delete -- neutral bypass valve being formed out of an extension of the follower sleeve --.
Column 4, line 5 and continued in line 6, after "position", insert --, the neutral bypass valve being formed out of an extension of the follower sleeve --.

Signed and Sealed this

*Twenty-sixth* Day of *November 1985*

[SEAL]

*Attest:*

DONALD J. QUIGG

*Attesting Officer*

*Commissioner of Patents and Trademarks*